US008192236B1

(12) United States Patent
Zhu

(10) Patent No.: US 8,192,236 B1
(45) Date of Patent: Jun. 5, 2012

(54) BATTERY CONNECTOR WITH IMPROVED CONTACTS

(75) Inventor: Yu Zhu, Shenzhen (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 13/195,847

(22) Filed: Aug. 2, 2011

(30) Foreign Application Priority Data

Jan. 12, 2011 (CN) ..... 201120008275.1

(51) Int. Cl.
*H01R 24/00* (2011.01)

(52) U.S. Cl. ..... 439/627

(58) Field of Classification Search ..... 439/627, 439/500, 862, 167
See application file for complete search history.

(56) References Cited

U.S. PATENT DOCUMENTS 7,517,261 B2 * 4/2009 Wan et al. ..... 439/862
7,575,468 B2 * 8/2009 Chien et al. ..... 439/500
7,722,393 B1 * 5/2010 Huang et al. ..... 439/571
7,981,539 B2 * 7/2011 Lai ..... 429/159
8,092,236 B2 * 1/2012 Yang et al. ..... 439/83
2008/0268712 A1 * 10/2008 Wan et al. ..... 439/627
2009/0170374 A1 * 7/2009 Chu et al. ..... 439/627
2009/0298343 A1 * 12/2009 Wu et al. ..... 439/627
2010/0120291 A1 * 5/2010 Hu et al. ..... 439/627
2010/0136838 A1 * 6/2010 Huang et al. ..... 439/627

* cited by examiner

*Primary Examiner* — Jean F Duverne
(74) *Attorney, Agent, or Firm* — Wei Te Chung; Andrew C. Cheng; Ming Cheih Chang

(57) ABSTRACT

A battery connector includes an insulative housing and a plurality of contacts received in the housing. The housing defines a plurality of receiving passageways running through a front mating face to define an opening. The opening defines an upper and a lower inside face. Each contact includes an engaging portion exposing to the front face through the opening. The engaging portion intersect with the front face, defining a first joint point adjacent to the upper inside face and a second joint point adjacent to the lower inside face. The engaging portion defines a free distal end abutting against an inner face of the housing. The housing further defines a protrusion extending from the lower inside face towards the upper inside face in a condition that a distance between the second joint point and a top face of the protrusion is smaller than a length of the free distal end.

20 Claims, 4 Drawing Sheets

BATTERY CONNECTOR WITH IMPROVED CONTACTS

BACKGROUND OF THE INVENTION

1. Field of the Invention

The present invention relates to a battery connector, and more particularly to a battery connector with improved contacts to prevent the contacts out of a housing.

2. Description of the Related Art

A traditional battery connector includes an insulative housing and a plurality of contacts received in the insulative housing. The insulative housing defines a front mating face, a rear face and a plurality of receiving passageways running through the front and rear faces. Each contact defines an engaging portion exposing to the mating face, a retaining portion retained in the receiving passageway and a soldering portion extending out of the receiving passageway. The engaging portion defines a free distal end abutting against an inner face opposite to the front face of a front wall. When a battery is mated with the battery connector, the engaging portion is urged to move rearwards and downwards. Due to the downward force, the free end would be easily out of the receiving passageway.

In view of the above, a new battery connector that overcomes the above-mentioned disadvantages is desired.

SUMMARY OF THE INVENTION

Accordingly, an object of the present invention is to provide a battery connector with improved contacts to prevent the contacts out of a housing.

To fulfill the above-mentioned object, a battery connector comprises an insulative housing defining a front mating face, a rear face and a plurality of receiving passageways running through the front face to define an opening, the opening defining an upper inside face and a lower inside face; a plurality of contacts received in the insulative housing and includes a retaining portion retained in the receiving passageway, an elastic portion and a soldering portion located at two sides of the retaining portion, and an engaging portion exposing to the front face through the opening; the engaging portion intersect with the front face, defining a first joint point adjacent to the upper inside face and a second joint point adjacent to the lower inside face, the engaging portion defining a free distal end abutting against an inner face opposite to the front face of a front wall of the insulative housing; wherein the insulative housing further defines a protrusion extending from the lower inside face towards the upper inside face in a condition that a distance between the second joint point and a top face of the protrusion is smaller than a length of the free distal end.

Other objects, advantages and novel features of the invention will become more apparent from the following detailed description when taken in conjunction with the accompanying drawings.

DETAILED DESCRIPTION OF THE PREFERRED EMBODIMENT OF THE INVENTION

Reference will now be made to the drawings to describe the present invention in detail.

Figure 1:
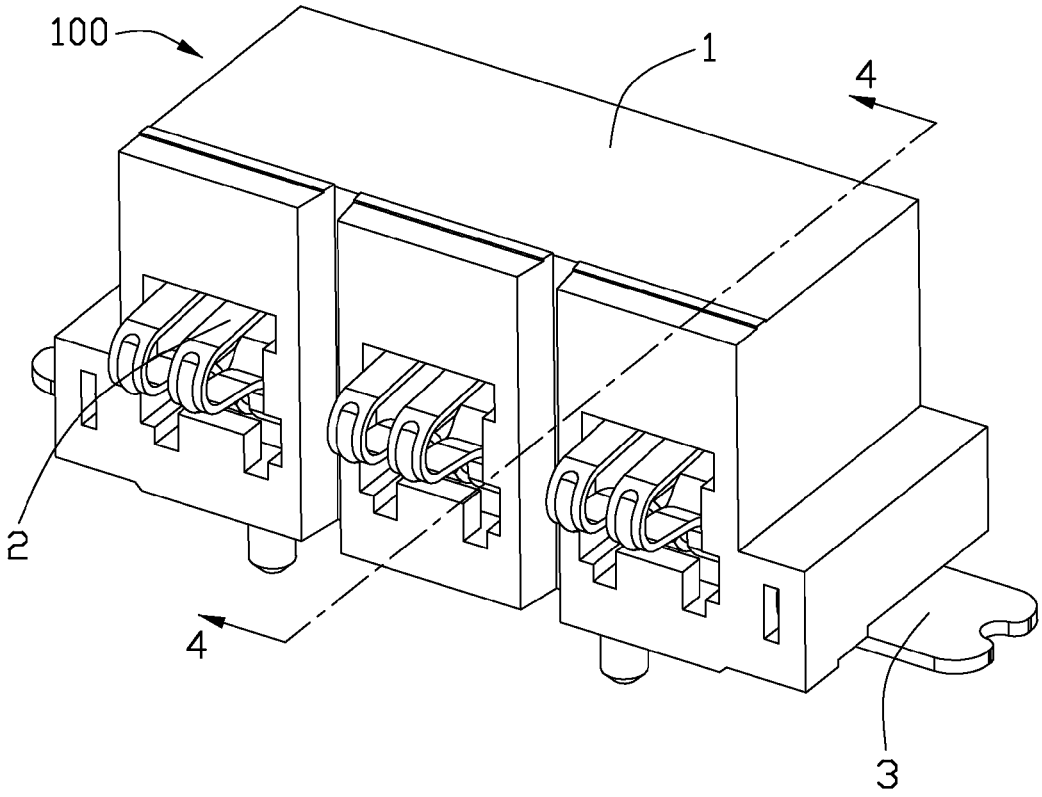
FIG. 1 is a perspective view of a battery connector of the present invention.

Referring to FIG. 1, a battery connector 100 includes an insulative housing 1, a plurality of contacts 2 received in the insulative housing 1 and a pair of board-lock pieces 3 secured in two sides of the insulative housing 1.

Figure 2:
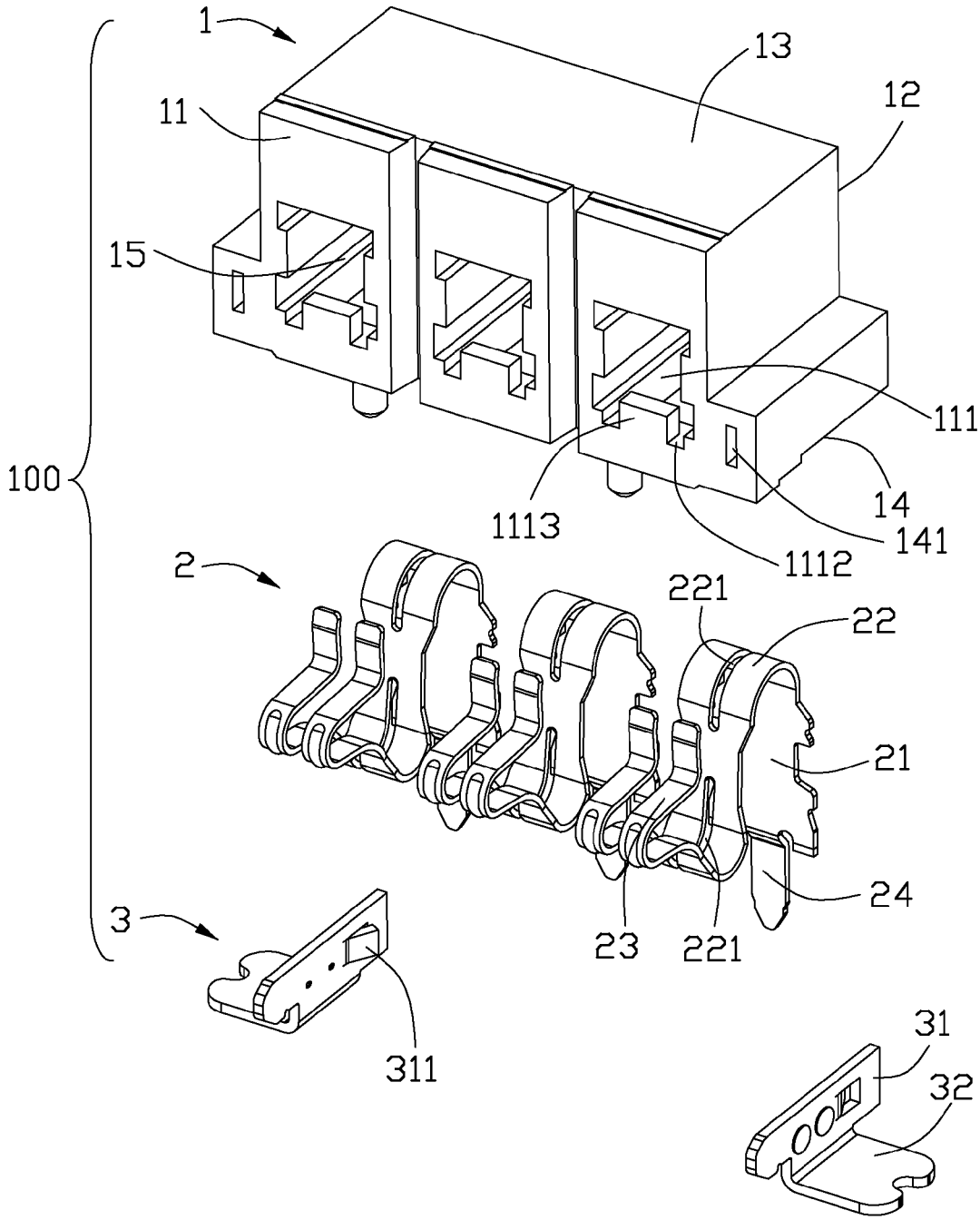
FIG. 2 is an exploded view of the battery connector of FIG. 1.

Referring to FIG. 2, the insulative housing 1 defines a mating front face 11, a rear face 12 and a top face 13 and a mounting bottom face 14 bridging the front face 11 and the rear face 12. The insulative housing 1 includes a plurality of receiving passageways 15 running through the front face 11, the rear face 12 and the bottom face 14.

Figure 3:
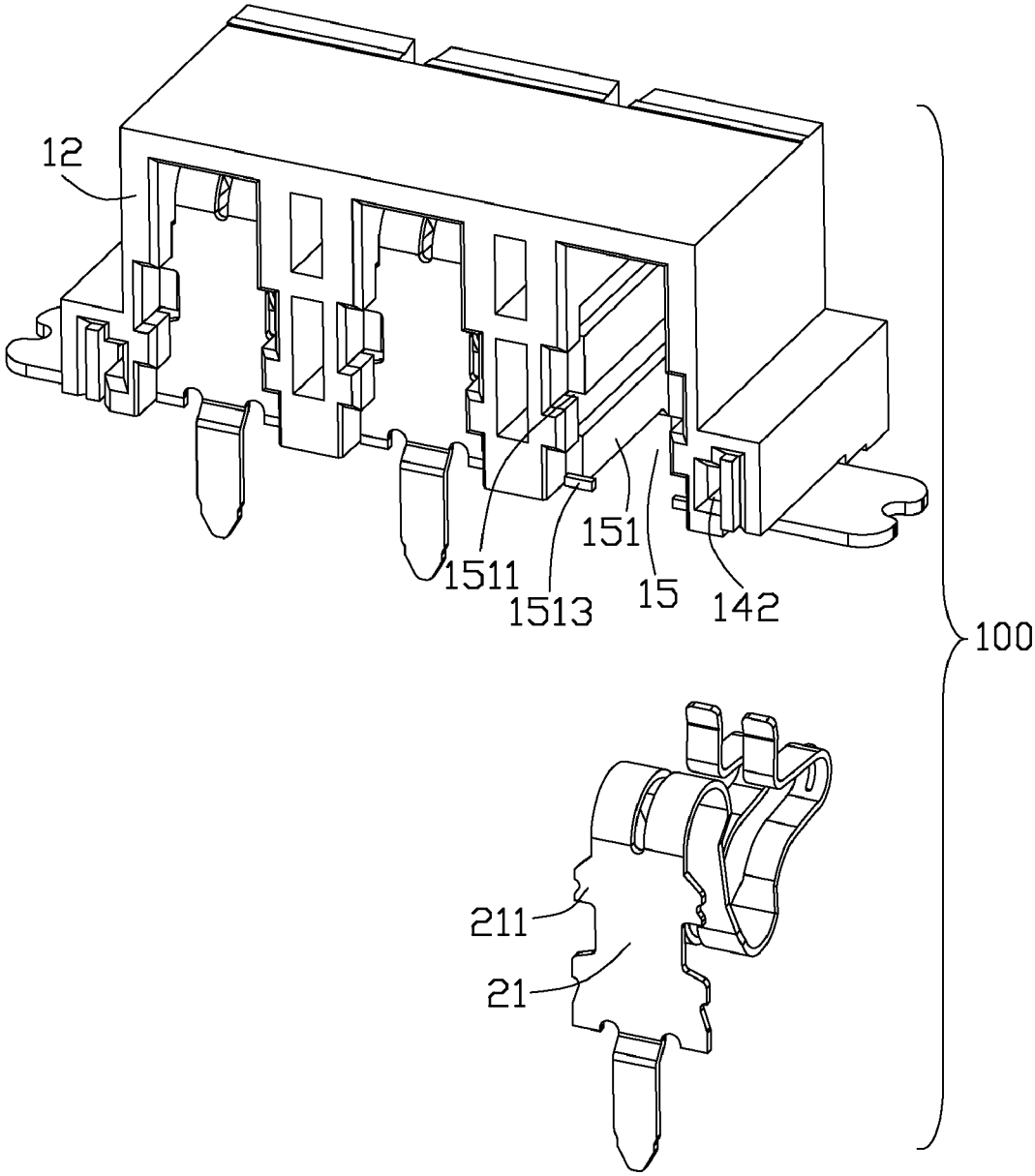
FIG. 3 is a perspective view of the battery connector of FIG. 1 wherein a contact is pulled out of the battery connector.

Referring to FIGS. 2 and 3, the contacts 2 are inserted into the receiving passageways 15 from the bottom face 14. Each contact 2 defines a retaining portion 21, an elastic portion 22 and a soldering portion 24 extending from two ends of the retaining portion 21, and an engaging portion 23 extending from the elastic portion 22. Each receiving passageway 15 defines a pair of side walls 151. Each side wall 151 defines a vertical guiding groove 1511 and a position block 1513 at a bottom of the guiding groove 1511 at a side close to the front face 11. The retaining portion 21 defines a plurality of barbs 211. The retaining portions 21 are inserted into the receiving passageways 15 along the guiding grooves 151 and then move upwards along the vertical guiding groove 1511 and then move forwards to resist against the position blocks 1513 by bottom ends of the barbs 211. Each elastic portion 22 is configured in an S shaped and defines two arc-shaped grooves 221 at two turning points. The soldering portions 24 extend out of the receiving passageways 15 and weld to a print circuit board (not shown).

Figure 4:
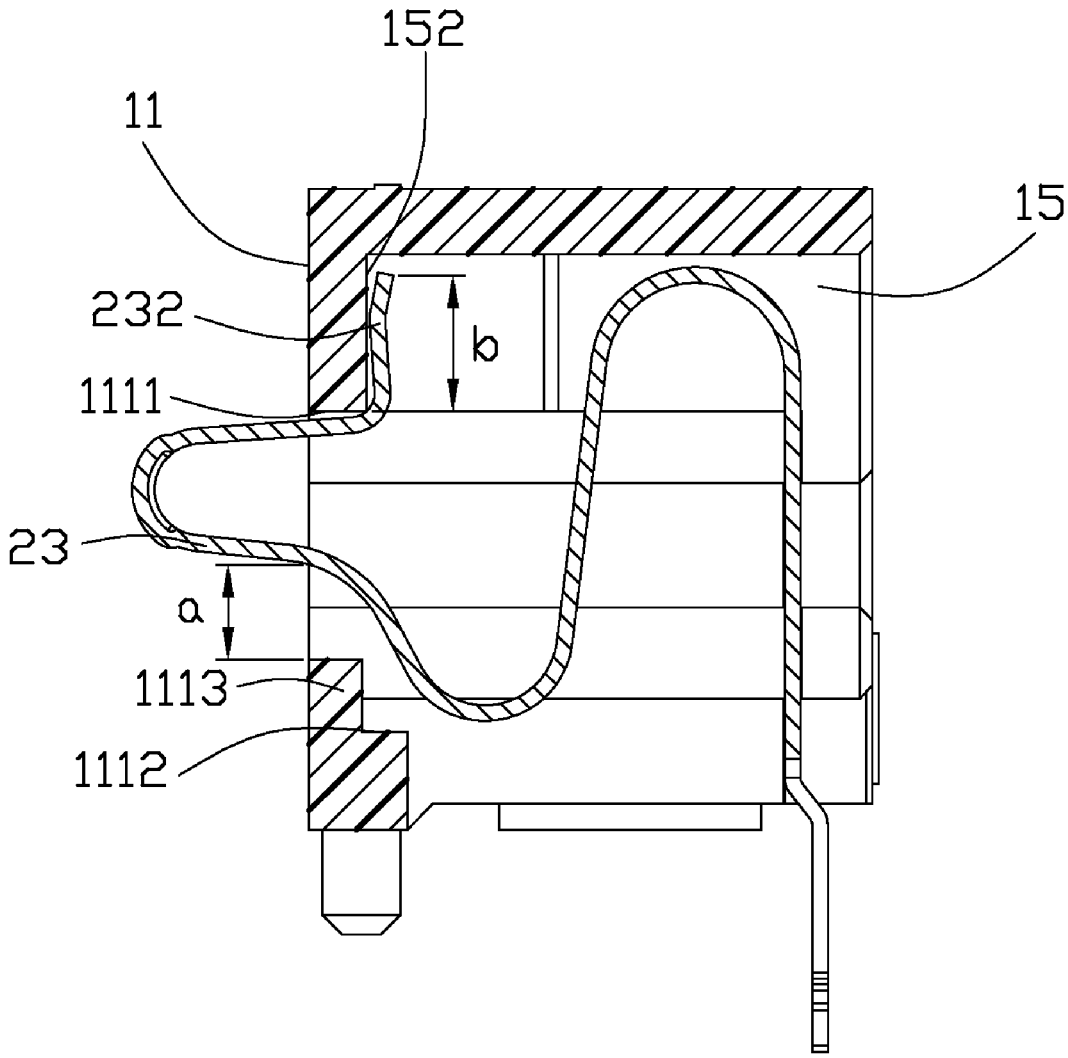
FIG. 4 is a cross sectional view of the electrical connector taken along line 4-4 in FIG. 1.

Each contact 2 includes two engaging portions 23 divided by one of the arc-shaped grooves 221. Referring to FIG. 4, the engaging portions 23 expose to the front face 11 and define free distal ends 232 abutting against an inner face 152 opposite to the front face 11 of a front wall of the insulative housing 1. The length of the free distal end 232 is defined as b which starts from bend point of the distal end from the engaging portion to a free end point. The receiving passageways 15 run through the front face 11 to form an opening 111. The opening 111 defines an upper inside face 1111 and a lower inside face 1112. The engaging portion 23 extends out of the receiving passageway 15 from the opening 111, so the arch engaging portion intersect with the front face with two joint point, a first joint point adjacent to the upper inside face 1111 and a second joint point adjacent to the lower inside face 1112. The insulative housing 1 further includes a protrusion 1113 perpendicularly extending from the lower inside face 1112 toward the upper inside face 1111. The protrusion 1113 is located at a front side of the lower inside face 1112 close to the front face 11. The distance between a top face of the protrusion 1113 and the second joint point is defined as a. The length b is larger than the length a. When a battery is mated with the battery connector, the engaging portion 23 is urged to move backwards and downwards. The engaging portion 23 moves downwards for some distance until the engaging portion 23 resists at the protrusion 1113. Due to the length b is larger than the length a, the free distal end 232 of the engaging portion 23 would not be out of the insulative housing 1 during the engaging portion 23 moves downwards.

Referring to FIGS. 2-3, the block-lock piece 3 is configured with a L shaped. The insulative housing 1 defines a pair of retaining grooves 141 running the rear face 12 and the bottom face 14 and a pair of position grooves 142 communicating with the retaining grooves 141. The block-lock piece 3 is inserted into the retaining grooves 141 from the rear face 121 and includes a position portion 31 received in the retaining groove 141 and a tail portion 32 extending out of the retaining groove 141 from the bottom face 14. The position portion 31 is perpendicular with the tail portion 32. Each position portion 31 defines a slant piece 311 secured in the position groove 142.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A battery connector comprising:

an insulative housing defining a front mating face, a rear face and a plurality of receiving passageways running through the front face to define an opening, the opening defining an upper inside face and a lower inside face;

a plurality of contacts received in the insulative housing and including a retaining portion retained in the receiving passageway, an elastic portion and a soldering portion located at two sides of the retaining portion, and an engaging portion exposing to the front face through the opening;

the engaging portion intersecting with the front face, defining a first joint point adjacent to the upper inside face and a second joint point adjacent to the lower inside face, the engaging portion defining a free distal end abutting against an inner face opposite to the front face of a front wall of the insulative housing;

wherein the insulative housing further defines a protrusion extending from the lower inside face towards the upper inside face in a condition that a distance between the second joint point and a top face of the protrusion is smaller than a length of the free distal end.

2. The battery connector as claimed in claim 1, wherein the protrusion is perpendicular with the lower inside face.

3. The battery connector as claimed in claim 2, wherein the protrusion locates at a front side of the lower inside face close to the front face.

4. The battery connector as claimed in claim 3, wherein each contact comprises a pair of engaging portions located in one receiving passageway.

5. The battery connector as claimed in claim 4, wherein each elastic portion is configured with an S shaped and defines two arc-shaped grooves at two turning points.

6. The battery connector as claimed in claim 5, wherein two engaging portions of one contact are divided with one of the arc-shaped grooves.

7. The battery connector as claimed in claim 1, wherein each receiving passageway defines a pair of side walls defining vertical guiding grooves, and the retaining portions are inserted into the receiving passageways along the guiding grooves.

8. The battery connector as claimed in claim 7, wherein each side wall further includes a position block at a bottom of the guiding groove at a side close to the front face, and the retaining portions move upwards along the vertical guiding groove and then move forwards to resist against the position blocks by bottom ends thereof.

9. The battery connector as claimed in claim 8, wherein the battery connector further comprise a pair of L-shaped board-lock pieces secured in two sides of the insulative housing.

10. The battery connector as claimed in claim 9, wherein the insulative housing defines a retaining groove running through a bottom face thereof and a position groove in communication with the retaining groove, and wherein the board-lock piece extends out of the retaining groove from the bottom face and defines a slant piece secured in the position groove.

11. A battery connector comprising:

an insulative housing comprising a front wall defining a front face, an inner face opposite to the front face with an opening through the front and inner faces;

contacts, each comprising a retaining portion retained in the insulative housing, a U shaped engaging portion projecting from the front face through the opening and an elastic portion connecting with the retaining portion and the engaging portion and deforming to allow the engaging portion rearward shifting, a distal end bending from an upper end of the engaging portion and pressing against the inner face with a whole vertical height;

wherein a second vertical height is defined between a lower bottom of the opening and a lower intersection by the engaging portion and the front face, the second vertical height is smaller than the said whole vertical height.

12. The battery connector as claimed in claim 11, wherein the elastic portion is configured with an S shape and defines two arc-shaped grooves at turning points thereof.

13. The battery connector as claimed in claim 12, wherein the engaging portion is divided into two sections by one said arc-shaped groove.

14. A battery connector for mounting to a printed circuit board, comprising:

an insulative housing defining a plurality of passageways each forwardly, rearwardly and downwardly communicating with an exterior;

each of said passageways further equipped with a vertical guiding groove around a rear portion under condition that said vertical guiding groove define a plurality of first and second portions formed by a plurality of alternately arranged blocks by two sides of the vertical guiding groove wherein the first portions facing the exterior rearwardly are wider than the second portions facing the exterior forwardly; and a plurality of contacts disposed in the corresponding passageways, respectively, each of said contacts defining a vertical retaining portion and a front engaging portion with a curved elastic portion therebetween, the vertical retaining portion defining a plurality of barbs on two sides; wherein the contact is horizontally assembled into the corresponding passageway from a rear face of the housing forwardly to have the barbs enter the corresponding first portions, and successively moves upwardly with a first distance to enter the second portions in an interference fit so as to retain the contact in the passageway with the engaging portion extending forwardly beyond a front face of the housing.

15. The battery connector as claimed in claim 14, wherein the engaging portion is further equipped with a free end region, and each of the passageways defining in the front face a front opening through which the engaging portion forwardly extends under condition that the front opening is larger than the engaging portion in a vertical direction so as to allow the engaging portion to be moveable therein in the vertical direction with a second distance which is not larger than a dimension of the free end region in the vertical direction so as to assure said free end region will not be dropped from the passageway from the front opening.

16. The battery connector as claimed in claim 15, wherein the second distance is not less than the first distance.

17. The battery connector as claimed in claim 14, wherein each of the vertical guiding grooves are further equipped with a pair of position blocks which are a bottom portion for upwardly supporting the retaining portion of the corresponding contact.

18. The battery connector as claimed in claim 14, wherein the curved elastic portion includes a downwardly extending U-shaped section linked to the retaining portion, and an upwardly extending U-shaped section linked between the downwardly extending U-shaped section and the engaging portion.

19. The battery connector as claimed in claim 18, wherein the downwardly extending U-shaped section upwardly reaches a level similar to that of a free end region of the engaging portion.

20. The battery connector as claimed in claim 18, wherein the upwardly extending U-shaped section is downwardly moveable to a lower level which is not below a bottom face of the housing so as not to interfere with said printed circuit board which is used for mounting of the battery connector thereon.

* * * * *